US006456818B1

(12) United States Patent
Nakayama et al.

(10) Patent No.: US 6,456,818 B1
(45) Date of Patent: Sep. 24, 2002

(54) IMAGE HEATING APPARATUS OF INDUCTION HEATING TYPE

(75) Inventors: Toshinori Nakayama, Chiba; Osamu Watanabe, Kanagawa, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/924,450

(22) Filed: Aug. 9, 2001

(30) Foreign Application Priority Data

Aug. 11, 2000 (JP) ..... 2000-244727
Aug. 8, 2001 (JP) ..... 2001-240401

(51) Int. Cl.[7] ..... G03G 15/20
(52) U.S. Cl. ..... 399/328; 219/216; 219/619; 399/330
(58) Field of Search ..... 399/69, 328–330; 219/216, 619

(56) References Cited

U.S. PATENT DOCUMENTS 5,475,194 A 12/1995 Watanabe et al. ..... 219/216
6,055,403 A 4/2000 Watanabe ..... 399/328
6,078,780 A * 6/2000 Abe et al. ..... 399/329
6,122,477 A * 9/2000 Parker ..... 399/330
6,198,901 B1 3/2001 Watanabe ..... 399/328
6,278,852 B1 * 8/2001 Hayashi ..... 219/216 X

FOREIGN PATENT DOCUMENTS

JP 54-39645 3/1979
JP 59-33787 2/1984
JP 10-282826 10/1998

* cited by examiner

*Primary Examiner*—William J. Royer
(74) *Attorney, Agent, or Firm*—Fitzpatrick, Cella, Harper & Scinto

(57) ABSTRACT

An image heating apparatus for heating an image formed on a recording material, including a heating member, and an excitation coil for generating a magnetic field to induce an eddy current in the heating member, wherein of total electric power applied to the coil, the relation between active electric power W and reactive electric power W' is $0.1 \leqq W/(W+W') \leqq 0.8$.

11 Claims, 9 Drawing Sheets

IMAGE HEATING APPARATUS OF INDUCTION HEATING TYPE

BACKGROUND OF THE INVENTION

1. Field of the Invention

The invention relates to an image heating apparatus like a heating and fixing device mounted on an image forming apparatus such as a copier or a printer, and particularly to an image heating apparatus of the induction heating type.

2. Related Background Art

A copier of the electrophotographic type or the like is provided with a heating apparatus for fixing a toner image transferred onto a sheet such as recording paper or a transferring material which is a recording medium on the sheet.

The heating apparatus has, for example, a fixing roller called also a heat roller for thermally fusing the toner on the sheet, and a pressure roller brought into pressure contact with the fixing roller to nip the sheet between the pressure roller and the fixing roller. The fixing roller is formed into a hollow shape, and a heat generating member is held on the axis of the fixing roller by holding means. The heat generating member is comprised of a tubular heat generating heater such as a halogen lamp, and generates heat by a predetermined voltage being applied thereto. Since the halogen lamp is located on the axis of the fixing roller, the heat generated by the halogen lamp is uniformly radiated to the inner wall of the fixing roller, and the temperature distribution in the outer wall of the fixing roller becomes uniform in the circumferential direction thereof. The outer wall of the fixing roller is heated until the temperature thereof becomes a temperature suited for fixing (e.g. 150 to 200° C.). In this state, the fixing roller and the pressure roller are rotated in opposite directions while being in pressure contact with each other, and nip and convey the sheet to which the toner adheres therebetween. In the pressure contact portion (hereinafter referred to also as the nip portion) between the fixing roller and the pressure roller, the toner on the sheet is fused by the heat of the fixing roller, and is fixed on the sheet by the pressure acting from the two rollers.

However, in the above-described heating apparatus provided with the heat generating member comprised of a halogen lamp or the like, the radiant heat from the halogen lamp is utilized to heat the fixing roller and therefore, a relatively long time has been required as the time until the temperature of the fixing roller reaches a predetermined time suited for fixing after a power source has been turned on (hereinafter referred to as the warm-up time). This has led to the problem that in the meantime a user cannot use the copier and is compelled to wait for a relatively long time.

On the other hand, if a great deal of electric power is applied to the fixing roller to attempt the shortening of the warm-up time and improve the operability for the user, there has arisen the problem that the consumed electric power in the heating apparatus is increased against energy saving.

Therefore, to enhance the commercial value of the copier or the like, more attention and importance have been attached to contrive the compatibility of the energy saving (lower consumption of electric power) of the heating apparatus and the operability (quick print) for the user.

As an apparatus which meets such a requirement, there has been proposed a heating apparatus of the induction heating type utilizing high frequency induction as a heat source, as shown in Japanese Patent Application Laid-Open No. 59-33787.

The induction heating apparatus is such that a coil is concentrically disposed in a hollow fixing roller comprising a metallic conductor, and by a high frequency magnetic field generated by a high frequency current being made to flow to the coil, an induction eddy current is created in the fixing roller, and the fixing roller itself is caused to generate Joule heat by the skin resistance of the fixing roller itself.

According to the heating apparatus of the induction heating type, electro-thermal conversion efficiency is very much improved and therefore, the shortening of the warm-up time becomes possible.

In such a heating apparatus of the induction heating type, however, a great current of several A to several tens of A flows through the coil, and this has led to the problem of the temperature rise by the Joule heat generation of the coil itself.

Also, when an induction coil is disposed in the internal space of a heating member, efficient heat radiation does not take place and the temperature rise of the coil becomes very great.

When the temperature rise of such an induction coil occurs, there has been the problem that for example, the covering of the induction coil is fused by heat and the insulativeness is spoiled.

So, as disclosed, for example, in Japanese Patent Application Laid-Open No. 54-39645 and Japanese Patent Application Laid-Open No. 10-282826, there has been made a proposition to provide a cooling mechanism such as blowing means to suppress the temperature rise of the induction coil.

However, the provision of a cooling mechanism such as blowing means leads not only to a correspondingly higher cost, but also to the necessity of securing a space therefor. Further, it has led to the waste of energy to indirectly cool the heat generated by consuming electric power.

SUMMARY OF THE INVENTION

The present invention has been made in view of the above-noted problems and an object thereof is to provide an image heating apparatus which can suppress the temperature rise of an induction coil.

Another object of the present invention is to provide an image heating apparatus which suffers little from the loss of a power supply.

Still another object of the present invention is to provide an image heating apparatus which is excellent in heat generating efficiency.

Yet still another object of the present invention is to provide an image heating apparatus comprising:

a heating member; and an excitation coil for generating a magnetic field to induce an eddy current in the heating member, wherein of the total electric power applied to the coil, the relation between active power W and reactive power W' is $$0.1 \leqq W/(W+W') \leqq 0.8.$$

Further objects of the present invention will become apparent from the following detailed description when read with reference to the accompanying drawings.

DESCRIPTION OF THE PREFERRED EMBODIMENTS

Figure 1:
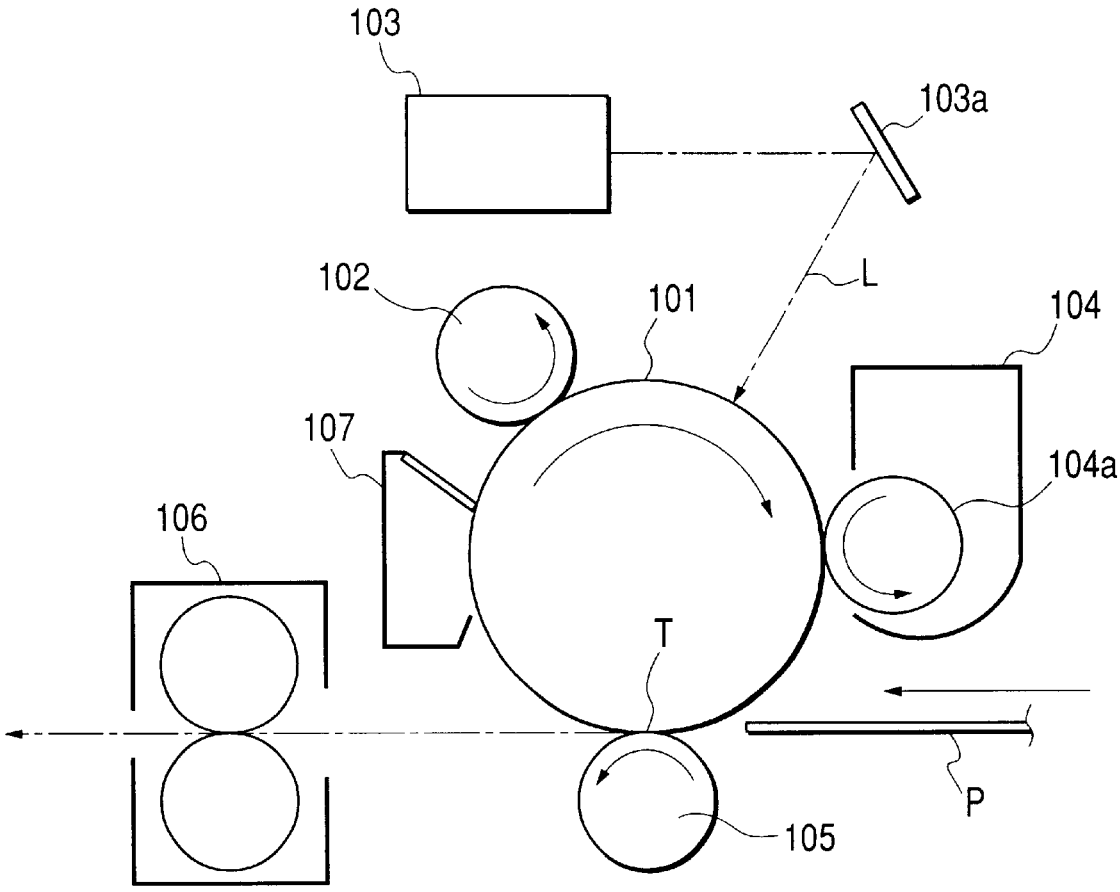
FIG. 1 is a schematic construction model view of an image forming apparatus according to a first embodiment.

Active power and reactive power will first be described. In the case of an alternating current, when a capacitor C and a coil L are present in the circuit, it is usual that by the balance thereof with a resistor R, a phase difference occurs between the current and the voltage. If in the circuit, the capacitor C and the coil L are absent and only the resistor R is present, no phase difference occurs and the phase difference is zero and therefore, the current and the voltage flow very normally at an equal phase. In this case, the current flows in synchronism with the time when the voltage is applied and therefore, the electric power is consumed effectively, and active electric power is 100% and reactive electric power is 0%. Also, electric power consumption W is represented as W=IV by the use of the value of effective current I and effective voltage V.

However, when the capacitor C and the coil L are present as previously described, a phase difference occurs between the voltage and the current and therefore, even at the moment when the voltage is applied, the current does not flow and therefore, there is born a state in which the electric power is not consumed effectively in spite of the same effective voltage and effective current as those mentioned previously. Therefore, if the phase difference between the voltage and current when effecting sine wave vibration is $\theta$, the effectively consumed electric power W is $W=IV\cos\theta$, and becomes smaller than previously. This effectively consumed electric power is referred to as the active electric power. The previous example has been an example in which the phase difference is zero and $\cos\theta=0$, and the simple product of the effective current and the effective voltage, i.e., the electric power consumption when the phase difference is zero minus the active electric power is referred to as the reactive electric power.

The total electric power applied to the coil, the active electric power W and the reactive electric power W' can be measured by a very common power meter for an alternating current power supply. In the case of the present invention, the effective current and effective voltage and electric power consumption of the coil are measured, and what is normally indicated as the electric power consumption is the active electric power. For example, the effective current 15A, effective voltage 130V and the electric power consumption 650 W are indicated, and the total electric power applied to the coil at this time is the product 15×130=1950 W of the effective current and the effective voltage, and it follows that the active electric power is 650 W as indicated and the reactive electric power is 1950−650=1300 W.

The power factor (W/(W+W')) is varied by such parameters as the shape (the number of turns and the width of turns) of the excitation coil, the distance between it and the heating member, the applied frequency, the material of the roller, and if a core is used, the magnetic characteristic of the core. If one of them is fixed, the power factor can be adjusted by regulating the other parameters. If for example, the gap of the excitation coil is made wide, the power factor can be made proper as by widening the width of turns of the coil and widening the width of the core, or increasing the rate it occupies in the magnetic path.

First Embodiment (1) Example of the Image Forming Apparatus

FIG. 1 is a schematic construction model view of an image forming apparatus in the present embodiment. The image forming apparatus of the present embodiment is a laser beam printer utilizing the transfer type electrophotographic process.

The reference numeral 101 designates an electrophotographic photosensitive drum as an image bearing member rotatively driven at a predetermined peripheral speed in the clockwise direction of the arrow.

The reference numeral 102 denotes a charging roller having electrical conductivity and elasticity as charging means brought into contact with the photosensitive drum 101 with a predetermined pressure force, and rotating following the rotation of the photosensitive drum 101 or rotatively driven. A predetermined charging bias voltage is applied from a power supply portion, not shown, to the charging roller 102, whereby the peripheral surface of the rotating photosensitive drum 101 is uniformly contact-charged to a predetermined polarity and potential.

The reference numeral 103 designates an exposing apparatus as information writing means. The exposing apparatus 103 is a laser scanner, and outputs a laser beam L modulated correspondingly to the time-series electrical digital pixel signal of image information, and scans and exposes the uniformly charged surface of the rotating photosensitive drum 101 through the intermediary of a turn-back mirror 103*a*. Thereby an electrostatic latent image corresponding to a scanning exposure pattern is formed on the surface of the photosensitive drum 101.

The reference numeral 104 denotes a developing device which develops the electrostatic latent image formed on the surface of the photosensitive drum 101 as a toner image. The reference character 104*a* designates a developing roller to which a predetermined developing bias voltage is applied from the power supply portion, not shown.

The reference numeral 105 denotes a transferring roller having electrical conductivity and elasticity as transferring means brought into pressure contact with the photosensitive drum 101 with a predetermined pressure force to thereby form a transfer nip portion T. A recording sheet (transferring material) P as a recording medium is fed from a sheet feeding portion, not shown, to the transfer nip portion T at predetermined control timing and is nipped and conveyed, and the toner image on the surface of the photosensitive drum 101 is sequentially transferred to the surface of the recording sheet P. An appropriate bias voltage of a polarity opposite to the charging polarity of the toner is applied from the power supply portion, not shown, to the transferring roller 105 at predetermined control timing.

The reference numeral 106 designates a heating apparatus (image heat fixing apparatus) for thermally fixing the unfixed toner image, and the recording sheet P passed through the transfer nip portion T is sequentially separated from the surface of the photosensitive drum 101 and is introduced into the heating apparatus 106, and the toner image on the recording sheet P is heated and pressurized and is fixed on the recording sheet P. The recording sheet P passed through the heating apparatus 106 is delivered as an image-formed article (a copy or a print). The heating apparatus 106 is a heating apparatus of the induction heating type according to the present invention, and will be described in detail in item (2) below.

The reference numeral 107 denotes a photosensitive drum surface cleaning apparatus which removes photosensitive drum surface contaminants such as untransferred toner and paper dust residual on the surface of the photosensitive drum 101 after the separation of the recording sheet and cleans the drum surface. The surface of the photosensitive drum cleaned by the cleaning apparatus 107 is repeatedly used for image formation.

(2) Heating Apparatus 106

Figure 2:
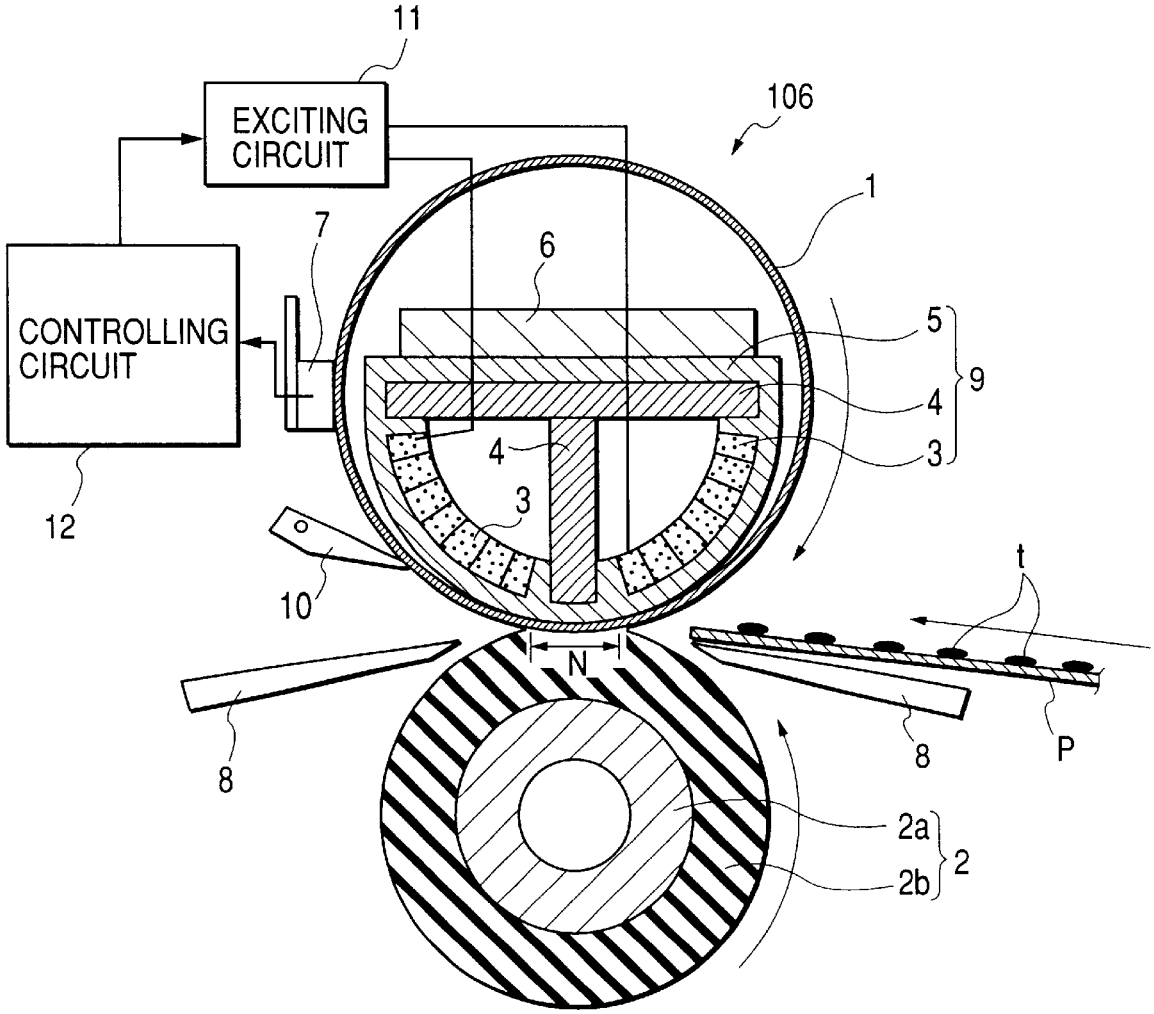
FIG. 2 is a transverse cross-sectional model view of a heating apparatus of the induction heating type.

FIG. 2 is a transverse cross-sectional model view of the heating apparatus 106. The heating apparatus 106 of the present embodiment is an apparatus of the heat roller type in which a recording material P such as a recording sheet or OHT as a material to be heated bearing an unfixed toner image t thereon is introduced into and nipped and conveyed by a fixing nip portion N which is the pressure contact portion between a fixing roller 1 as an induction-heated heating member and a pressure roller 2 as a pressure member, and in the fixing nip portion N, the unfixed toner image t is heat-and-pressure-fixed on the recording material P by the heat and nip pressure of the fixing roller 1.

The fixing roller 1 is a mandrel cylinder made of iron which is a magnetic metallic member having an outer diameter of 40 mm and a thickness of 0.7 mm. In order to enhance the mold releasing property of its surface, for example, a layer of fluorine resin such as PTFE or PFA having a thickness of 10 to 50 $\mu$m may be provided on its outer peripheral surface.

The pressure roller 2 comprises a hollow mandrel 2*a* and an elastic layer 2*b* which is a surface releasing heat-resistant rubber layer formed on the outer peripheral surface thereof.

The fixing roller 1 is mounted and supported with its opposite end portions rotatably journalled to a fixing unit frame, not shown, and is rotatively driven at a predetermined peripheral speed in the clockwise direction of the arrow by a driving system, not shown.

The pressure roller 2 is disposed parallel to the fixing roller 1 under the fixing roller 1 and is supported with the opposite end portions of its mandrel 2*a* rotatably journalled to the fixing unit frame and is pushed up and biased toward the rotary shaft of the fixing roller 1 by a biasing mechanism, not shown, using a spring or the like and is pressed against the underside of the fixing roller 1 with a predetermined pressure force. By the pressure contact of the pressure roller 2 against the fixing roller 1, the elastic layer 2*b* is elastically deformed in the pressure contact portion thereof with the fixing roller 1 and the fixing nip portion N of a predetermined width as a heating portion for heating the material to be heated is formed between the pressure roller 2 and the fixing roller 1. In the present embodiment, the pressure roller 2 is loaded with total pressure of about 304 N (about 30 Kg force), and the nip width of the fixing nip portion N in that case is about 6 mm. However, according to circumstances, the load may be varied to thereby change the nip width.

The pressure roller 2 is driven to rotate by the pressure contact frictional force in the fixing nip portion N with the rotative driving of the fixing roller 1.

The reference numeral 9 designates an excitation coil assembly as magnetic flux generating means comprising an excitation coil 3, a magnetic core 4, a coil holder 5, etc.

The coil holder 5 is a member having a semicircular trough-shaped transverse cross-section formed of heat-resistant resin such as PPS, PEEK or phenol resin, and the excitation coil 3 wound in the shape of a boat and the magnetic core 4 comprising flat ferrite plates having a thickness of 4 mm combined together into a T-shape are contained inside the coil holder 5 to thereby provide the excitation coil assembly 9.

The excitation coil assembly 9 is held by a stay 6 and is inserted into the hollow portion of the fixing roller 1, and the semicircular surface side of the coil holder 5 is made to face downwardly, and the opposite end portions of the stay 6 are fixed to and supported by the fixing unit frame, not shown. The distance of the gap between the outer surface adjacent to the semicircular surface side of the coil holder 5 and the inner surface of the hollow fixing roller 1 is 2 mm in the present embodiment.

The fixing roller 1 is rotatively driven, the pressure roller 2 is driven to rotate and an alternating current of 10 to 100 kHz is applied from an exciting circuit 11 to the excitation coil 3. A magnetic field induced by the alternating current makes an eddy current flow to the inner surface of the fixing roller 1 which is an electrically conducting layer, and generates Joule heat. That is, the fixing roller 1 is induction-heated. The temperature of the fixing roller 1 is detected by a temperature sensor 7 such as a thermistor disposed so as to abut against the surface of the fixing roller, and the detected temperature information (detection signal) thereof is inputted to a controlling circuit 12. On the basis of the inputted detected temperature information, the controlling circuit 12 increases or decreases the supply of electric power from the exciting circuit 11 to the excitation coil 3 so that the surface temperature of the fixing roller 1 may become a predetermined temperature, that is, the temperature of the fixing nip portion N may be automatically controlled to a predetermined fixing temperature.

Thus, in a state in which the fixing roller 1 and the pressure roller 2 are rotated and the fixing roller 1 is induction-heated and controlled to the predetermined temperature, the recording material P bearing the unfixed toner image t thereon is guided by a conveying guide 8 and is introduced into and nipped and conveyed by the fixing nip portion N, and the unfixed toner image t is heat-and-pressure-fixed on the surface of the recording material P by the heat and nip pressure of the fixing roller 1. The recording material P having left the fixing nip portion N is separated from the surface of the fixing roller 1 and is delivered and conveyed. The reference numeral 10 denotes a recording material separation claw disposed in contact with or proximity to the surface of the fixing roller 1 on the recording material exit side of the fixing nip portion N.

To increase the heat generation of the fixing roller 1, it is preferable to increase the number of turns of the excitation coil 3, or use a material of high permeability and low residual magnetic flux density such as ferrite or permalloy for the magnetic core 4, or heighten the frequency of the alternating current.

An alternating current of a high frequency is applied to the excitation coil 3 and therefore, a phase difference may occur between the fluctuating current and voltage. In this case, the electric power W effectively consumed in the coil is expressed as $$W=I_0V_0 \cos \theta$$

by the use of an effective current $I_0$ and effective voltage $V_0$ flowing through the excitation coil and the phase difference θ therebetween.

The cos θ is a parameter called power factor (PF), and is expressed also as $$PF=\cos \theta=W/(W+W')$$

by the use of the electric power W effectively consumed in the excitation coil and reactive electric power W'.

In the construction of the present embodiment, as previously described, the distance of the gap between the outer peripheral surface of the coil holder 5 and the inner surface of the fixing roller 1 is 2 mm, and the core 4 assumes a construction in which flat ferrite plates having a thickness of 4 mm are combined together in T-shape, and at this time, the power factor was 0.30.

Also, the detected temperature by the temperature sensor 7 was set so as to keep 180° C., and the conveyance speed of the recording sheet P was set to the order of 200 mm/sec.

In such a construction, the effective current value Ic having flowed through the excitation coil which was obtained by varying the number of copy sheets supplied for a minute under an environment of room temperature 25° C. and the value of the temperature Tc of the excitation coil will be shown in Table 1 below.

TABLE 1

| Sheet Supplying Mode | Ic | Tc |
|---|---|---|
| A | 7.8 | 188° C. |
| B | 10.9 | 194° C. |
| C | 14.4 | 205° C. |

The sheet supplying modes A, B and C shown in Table 1 are as follows:

A: a case where recording sheets were outputted at a rate of 20 sheets/min.

B: a case where recording sheets were outputted at a rate of 30 sheets/min.

C: a case where recording sheets were outputted at a rate of 40 sheets/min.

It will be seen from Table 1 that the temperature Tc of the excitation coil rises in accordance with an increase in the current value Ic flowing through the excitation coil. This can be understood from the fact that by the number of copy sheets per unit time being increased, the amount of electric power necessary to fix the toner on the recording sheets is increased and as the result, the current value flowing through the excitation coil increases, and the loss heat lost as Joule heat in the excitation coil increases in proportion to the square of the current value flowing through the excitation coil.

Next, the result of the same experiment carried out by the use of a system in which the construction of the heating apparatus (fixing device) was varied to thereby reduce the power factor to the order of 0.20 will be shown in Table 2 below. The power factor was reduced by decreasing the thickness of the flat ferrite core 4 to 3 mm.

TABLE 2

| Sheet Supplying Mode | Ic | Tc |
|---|---|---|
| A | 11.7 | 196° C. |
| B | 16.3 | 213° C. |
| C | 21.7 | 242° C. |

It will be seen from Table 2 that in all of the sheet supplying modes A, B and C, the temperature Tc of the excitation coil rises more than in an apparatus of a power factor 0.3. Particularly in the sheet supplying mode C, the temperature of the excitation coil is a high temperature equal to or higher than 220° C., and may cause the destruction of the insulation of resin film covering the copper wire or the abnormal temperature rise of the surface of the fixing roller. Taking the heat-resisting temperature of the coil into account, it is preferable to use a fixing unit having a power factor of 0.3 or greater in an image forming apparatus having the treating capability of 40 sheets/min. In an image forming apparatus having the treating capability of 30 sheets/min. or less, use can be made of a fixing unit having a power factor of 0.2 or greater.

The reason why as described above, the temperature of the excitation coil has risen by the power factor being reduced from 0.3 to 0.2 is that even if the number of output sheets per unit time is the same, the power factor has been aggravated, whereby the current value flowing through the excitation coil has been increased and as the result, the amount of Joule heat generation of the excitation coil has increased.

Figure 3:
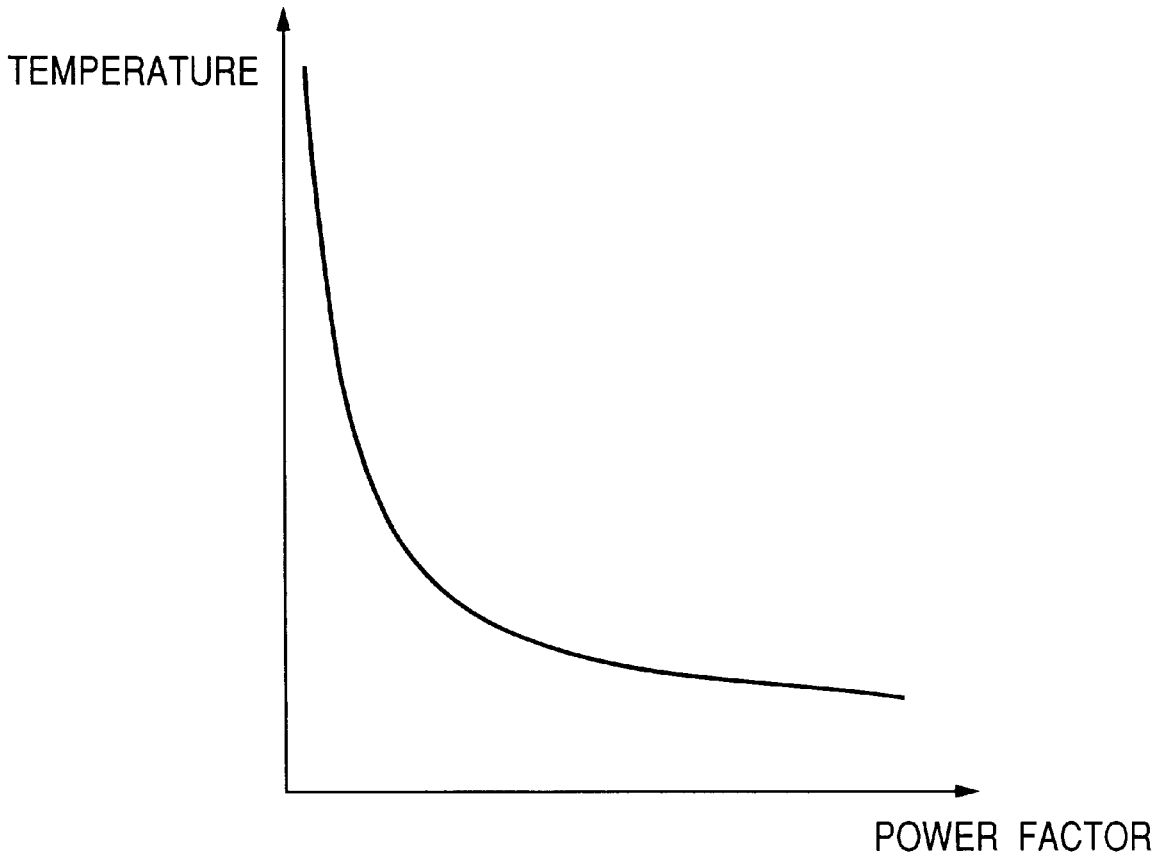
FIG. 3 is a graph showing the correlation between a power factor and the temperature of an excitation coil.

FIG. 3 shows the temperature rise curve of the excitation coil when the recording sheets were outputted in the same state and the power factor value of the fixing system was varied. It will be seen that as the power factor value becomes smaller, the temperature of the excitation coil rises suddenly.

As described above, when the excitation coil 3 becomes high in temperature, the electrical resistance thereof rises and the power supply efficiency becomes bad. When electric power is further supplied to make up for it, further heat generation is caused and the apparatus falls into a vicious spiral. The surface of the coil 3 is coated with insulative heat-resisting resin such as polyimide or amideimide, but if the amount of heat generation of the coil becomes too great, the heat-resisting temperature of the resin will be exceeded and the insulativeness thereof will be spoiled (the heat-resisting temperature of the heat-resisting resin such as polyimide wire (PIW) or amideimide wire (AIW) is about 220° C. to 235° C.). Also, the heat generation of the coil 3 causes the temperature rise of the core 4. If the core 4 exceeds Curie temperature, the permeability thereof will become extremely low and the heat generating efficiency will be aggravated.

The relation between the treating capability of the printer and the power factor of the fixing unit was examined with the heat-resisting temperature of the coil when use was made of the coil having its surface thus covered with resin as the reference. The result is shown in FIG. 9.

Figure 9:
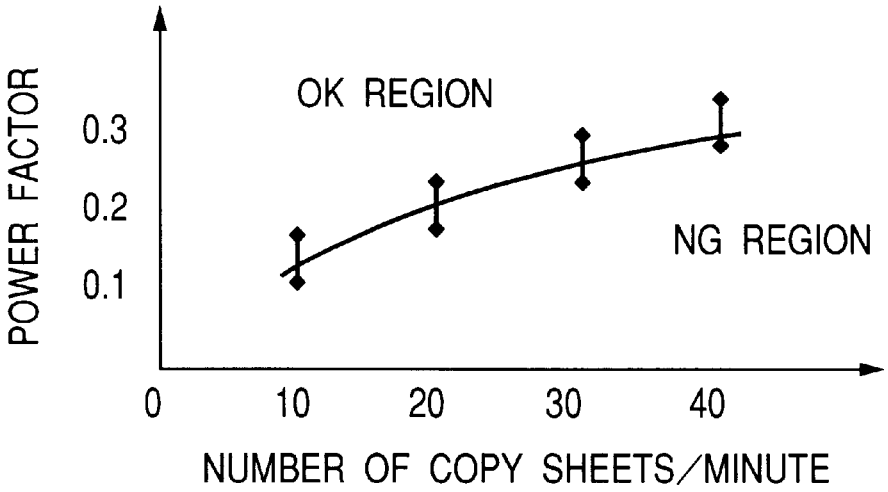
FIG. 9 is a graph showing the relation between the number of copy sheets per minute and the power factor of a fixing unit.

As can be understood from FIG. 9, it is necessary to use a fixing unit having a power factor of at least 0.1 in a printer wherein the number of output sheets per minute exceeds 10 sheets. In a printer wherein the number of output sheets per minute exceeds 20 sheets, it is necessary to use a fixing unit having a power factor of at least 0.15, and in a printer wherein the number of output sheets per minute exceeds 30 sheets, it is necessary to use a fixing unit having a power factor of at least 0.2, and in a printer wherein the number of output sheets per minute exceeds 40 sheets, it is necessary to use a fixing unit having a power factor of at least 0.25.

When the temperature rise of the excitation coil becomes remarkable, it can be coped with by shortening the distance between the excitation coil and the fixing roller, or disposing a high thermally conductive member near the excitation coil, but according to our studies, it has been found that whatever countermeasure may be used, to use the temperature of the excitation coil within a safe temperature range, a power factor of at least 0.10 is necessary. Further, taking the degree of freedom of the fixing system into account, ideally a power factor of 0.20 or greater is desirable.

On the other hand, as the power factor value approximates to 1.0, the power loss increases and the amount of heat generation of the power supply increases. Thereupon, electromagnetic conversion efficiency becomes bad and electric power cannot be applied to the heating member.

Figure 10:
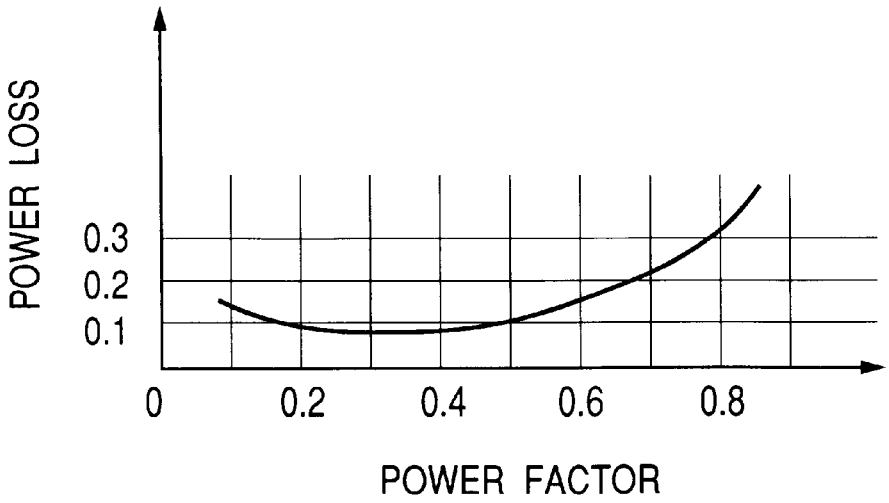
FIG. 10 is a graph showing the relation between the power factor of a fixing unit and power loss.

So, we tried to examine the relation between the power factor of the fixing unit and the amount of power loss. The result is shown in FIG. 10.

If the power loss is 0.3 or greater, the amount of heat generation in the power supply becomes great, and even if electric power is applied, the loss in the power supply is great, and the electric power effectively used for the heating of the heating member becomes small, and this is not efficient.

Consequently, in order to suppress the power loss, it is desirable that the upper limit of the power factor value be 0.8 or less and further, ideally the power supply efficiency be suppressed to the order of 0.1, and therefore it is preferable to set the upper limit of the power factor to 0.5 or less.

When the value of the power factor becomes great as described above, the temperature rise of the excitation coil is advantageous, but the switching loss in a driving power supply for generating a high frequency becomes great and the electric power lost in the power supply increases, and this is not efficient. Also, as the fixing system for making the power factor great, the changing of the construction such as increasing the cross-section of the core is difficult and therefore, it has been found that the order of 0.80 is the upper limit. Further, taking the electro-thermal conversion efficiency in the power supply and the securement of the degree of freedom of the fixing system into account, ideally it is desirable that the power factor be 0.50 or less.

As described above, taking both of the heat-resisting temperature of the coil and the power loss into account, it is necessary to set the power factor (W/(W+W')) of the fixing unit to 0.1 or greater and 0.8 or less. Taking the degree of freedom of design of the fixing device into account, 0.2 or greater and 0.5 or less is preferable.

More particularly, in a printer wherein the number of output sheets per minute is 10 sheets or greater, it is desirable to use a fixing device having a power factor of 0.1 or greater and 0.8 or less. In a printer wherein the number of output sheets per minute is 20 sheets or greater, it is desirable to use a fixing device having a power factor of 0.15 or greater and 0.8 or less. In a printer wherein the number of output sheets per minute is 30 sheets or greater, it is desirable to use a fixing device having a power factor of 0.2 or greater and 0.8 or less. In a printer wherein the number of output sheets per minute is 40 sheets or greater, it is desirable to use a fixing device having a power factor of 0.25 or greater and 0.8 or less.

Second Embodiment

Figure 4:
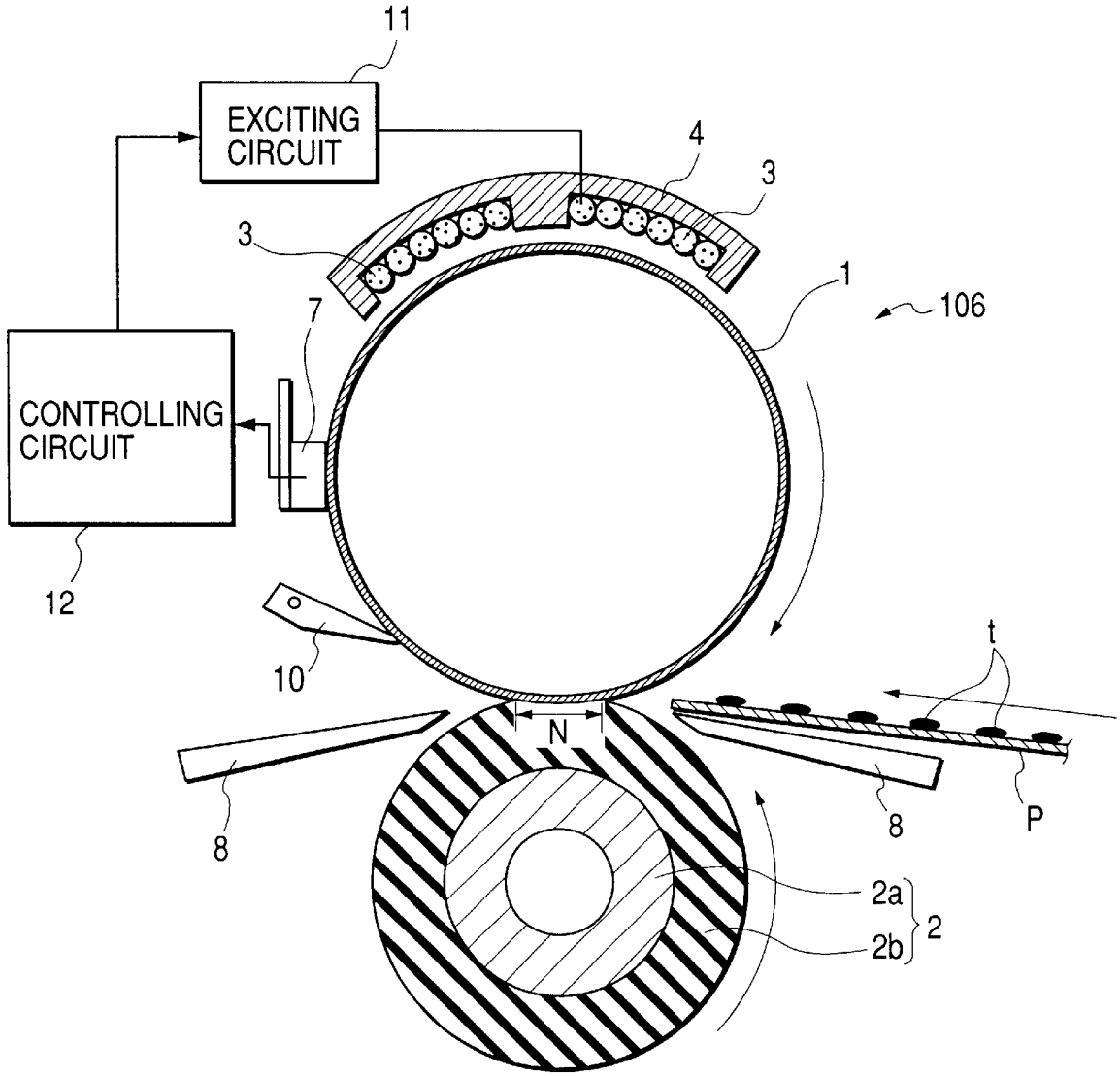
FIG. 4 is a transverse cross-sectional model view of another heating apparatus of the induction heating type (type 1).
Figure 5:
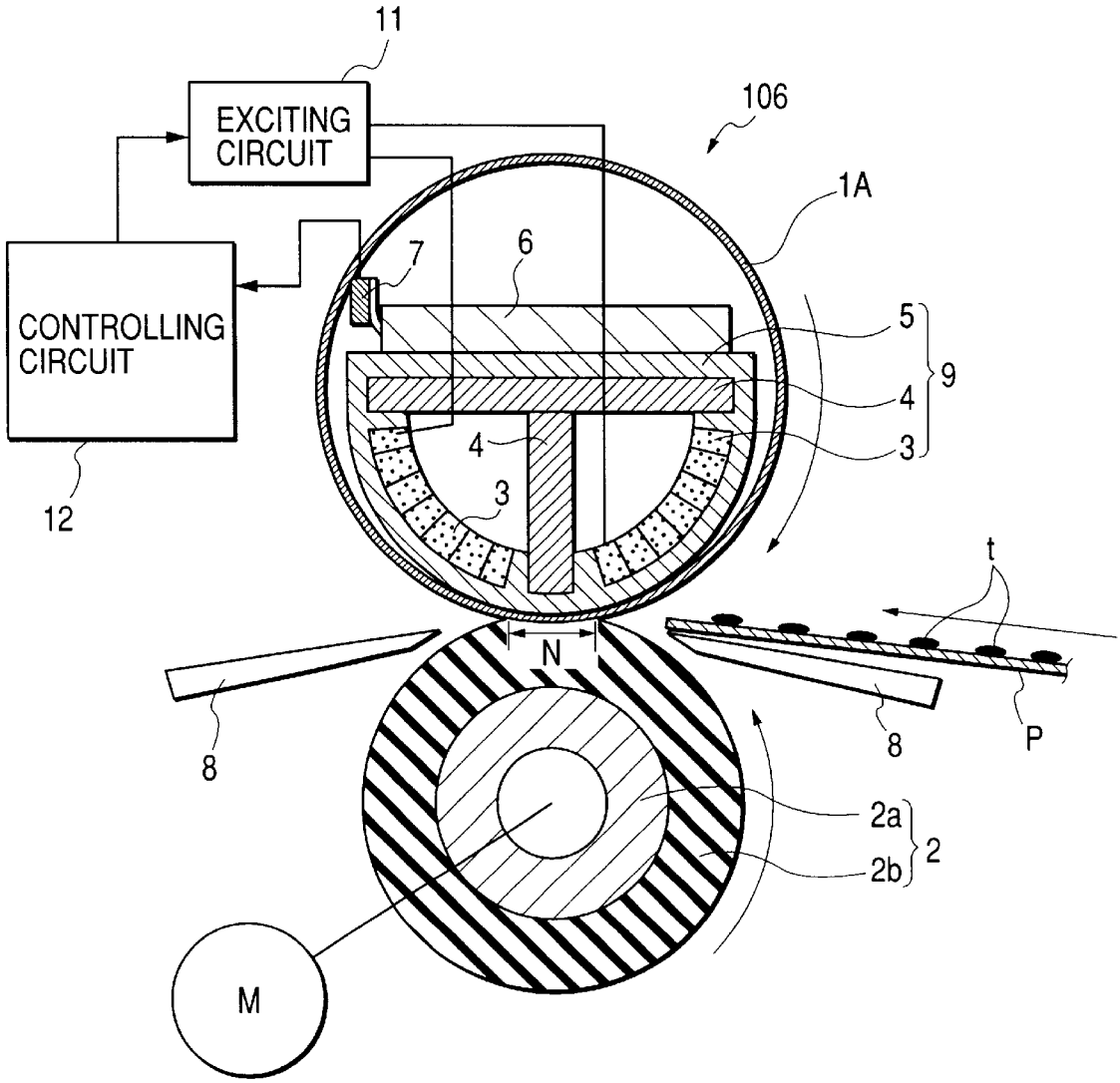
FIG. 5 is a transverse cross-sectional model view of another heating apparatus of the induction heating type (type 2).

The power factor range of the present invention can also be effectively applied to heating apparatus of other various induction heating types than the heating apparatus of the induction heating type like the above-described first embodiment. FIGS. 4 to 8 show heating apparatuses of such other induction heating types.

a) FIG. 4: The heating apparatus is of a type in which the excitation coil 3 is disposed externally of the fixing roller 1.

b) FIG. 5: The heating apparatus is of a type in which instead of the fixing roller 1, an endless or cylindrical magnetic metallic belt 1A is used as an induction heating member. The magnetic metallic belt 1A is a laminated member including a magnetic metallic layer, or a member of a magnetic metal in itself.

The magnetic metallic belt 1A is nipped between the coil holder 5 of the excitation coil assembly 9 inside it and the pressure roller 2 outside it to thereby form a fixing nip portion N with the coil holder 5 and the pressure roller 2 brought into pressure contact with each other.

In the apparatus, the pressure roller 2 is rotatively driven in the counter-clockwise direction of the arrow by driving means M (the pressure roller driven type). A rotational force acts on the magnetic metallic belt 1A by the pressure contact frictional force in the fixing nip portion N between the pressure roller 2 and the magnetic metallic belt 1A by the rotation of the pressure roller 2, whereby the magnetic metallic belt 1A is driven to rotate in the clockwise direction of the arrow while the inner surface thereof slides in close contact with the underside portion of the coil holder 5 of the excitation coil assembly 9 in the fixing nip portion N.

Figure 6:
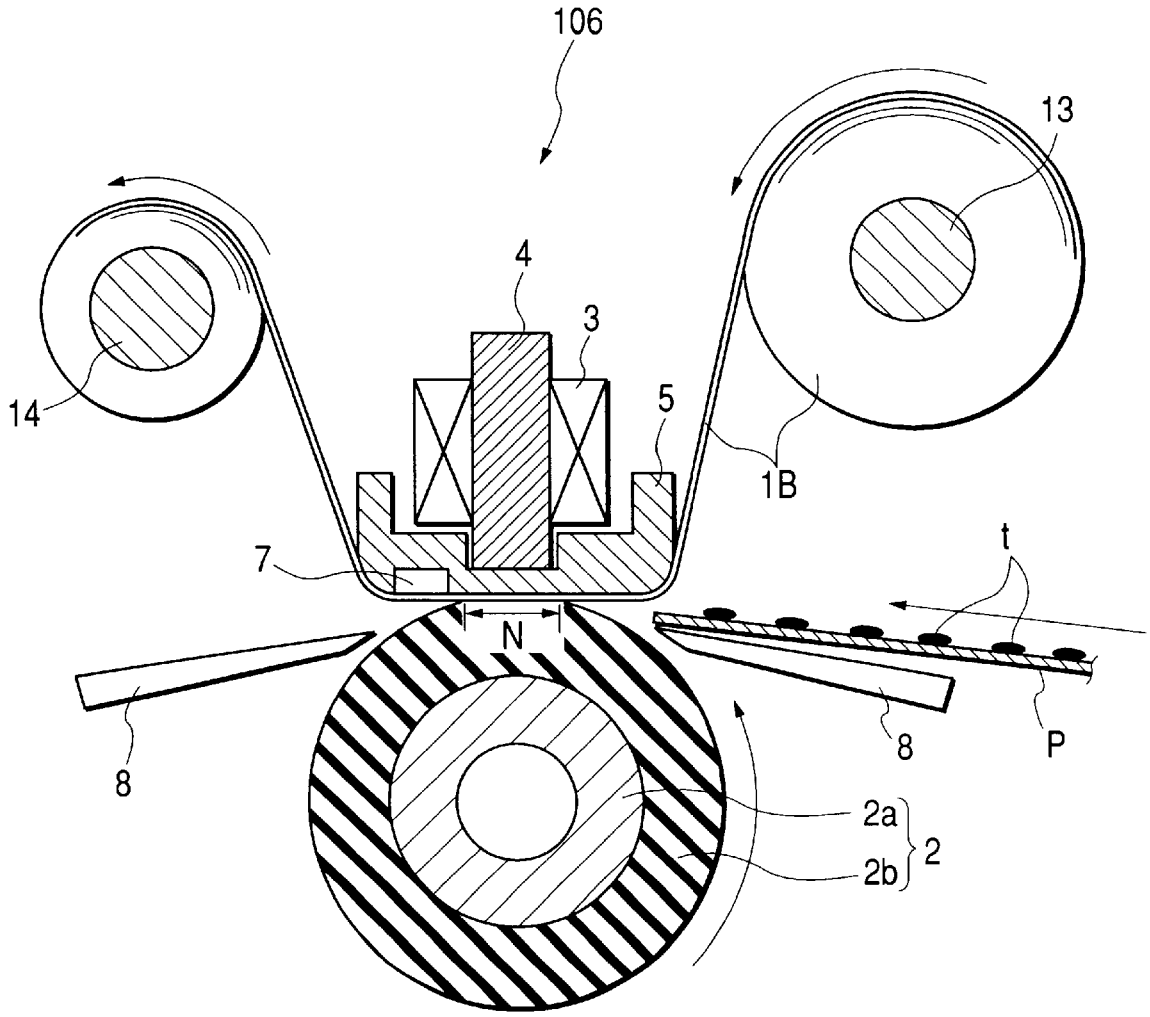
FIG. 6 is a transverse cross-sectional model view of another heating apparatus of the induction heating type (type 3).

The magnetic metallic belt 1A is induction-heated by a magnetic flux generated by the excitation coil 3, and a recording material P as a material to be heated is introduced into and heated by the fixing nip portion N.

c) FIG. 6: The apparatus is of a type in which a rolled long web-shaped magnetic metallic belt 1B having ends in used as an induction heating member. The magnetic metallic belt 1B is moved from a pay-out spool 13 to a take-up spool 14 via the fixing nip portion N. The magnetic metallic belt 1B is a laminated member including a magnetic metallic layer, or a member of a magnetic metal in itself.

Figure 7:
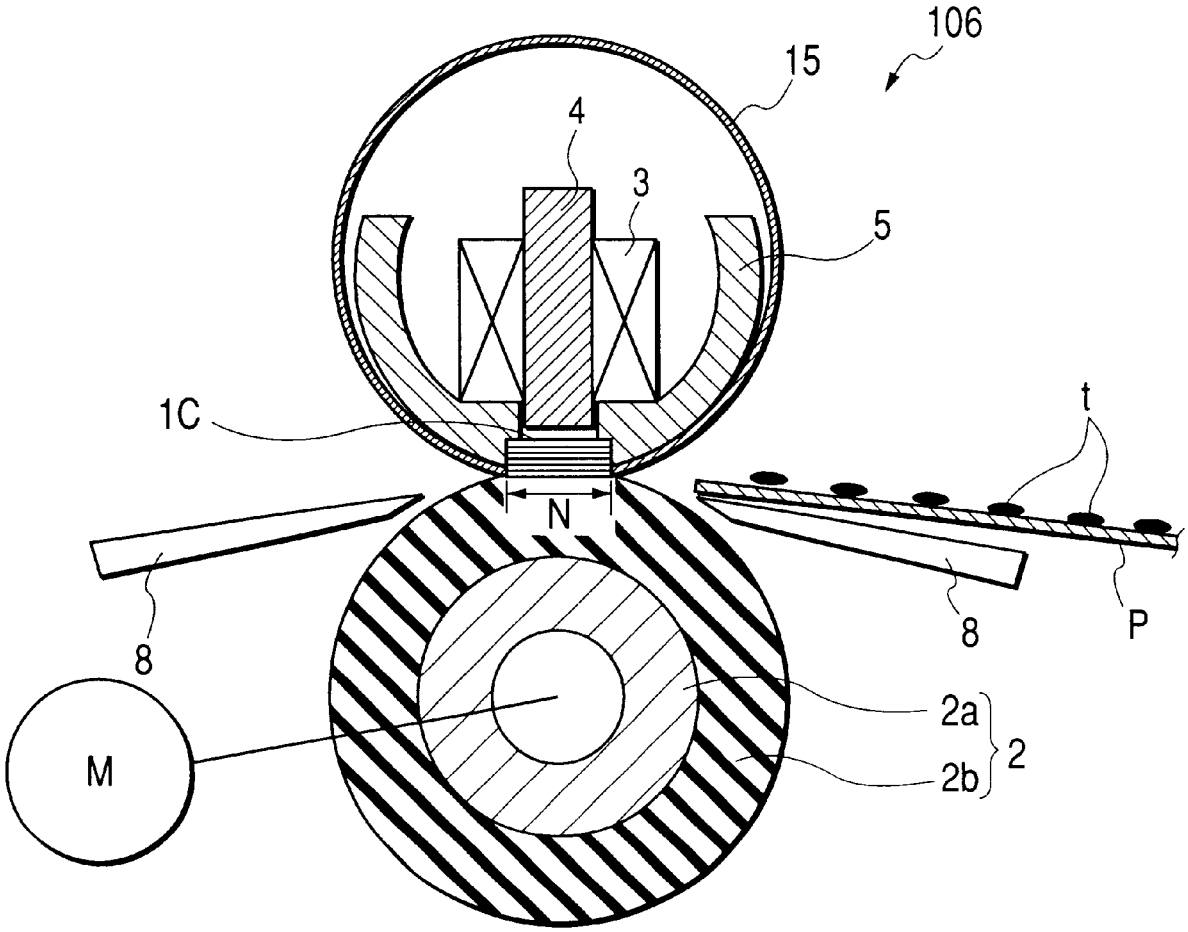
FIG. 7 is a transverse cross-sectional model view of another heating apparatus of the induction heating type (type 4).

The magnetic metallic belt 1B is induction-heated by a magnetic flux generated by the excitation coil 3 in the fixing nip portion N, and a recording material P as a material to be heated is introduced into and heated by the fixing nip portion N.

d) FIG. 7: In this apparatus, a magnetic metallic strip 1C as an induction heating member is fixedly disposed on the substantially central portion of the underside of a coil holder 5 along the length of the holder, and cylindrical heat-resistant film (fixing film) 15 is fitted on the assembly of an excitation coil 3, a magnetic core 4, the coil holder 5 and the magnetic metallic strip 1C, and with the fixing film 15 nipped between the fixed magnetic metallic strip 1C and a pressure roller 2, the magnetic metallic strip 1C and the pressure roller 2 are brought into pressure contact with each other to thereby form a fixing nip portion N.

In the apparatus, the pressure roller 2 is rotatively driven in the counter-clockwise direction of the arrow by driving means M (the pressure roller driven type). By the pressure contact frictional force in the fixing nip portion N between the pressure roller 2 and the fixing film 15 by the rotation of the pressure roller 2, a rotational force acts on the fixing film 15, which is thus driven to rotate in the clockwise direction of the arrow while the inner surface of the fixing film 15 slides in close contact with the underside portion of the fixed magnetic metallic strip 1C in the fixing nip portion N.

Figure 8:
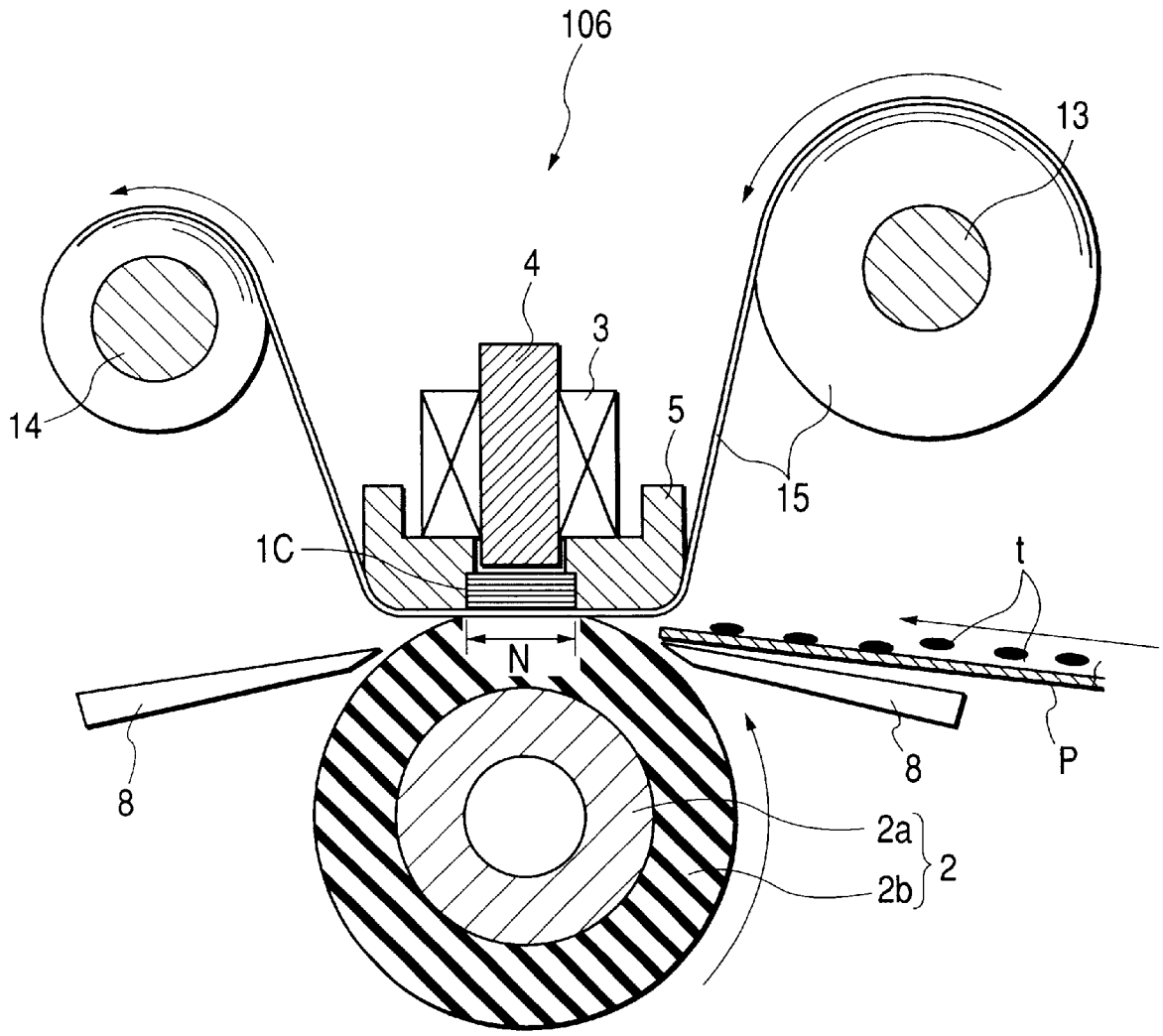
FIG. 8 is a transverse cross-sectional model view of another heating apparatus of the induction heating type (type 5).

The fixed magnetic metallic strip 1C is induction-heated by a magnetic flux generated by the excitation coil 3, and a recording material P as a material to be heated is introduced into the fixing nip portion N and is heated by the heat of the fixed magnetic metallic strip 1C through the fixing film 15 (the film heating type).

e) FIG. 8: The apparatus is such that in the film heating type apparatus of FIG. 7, the fixing film 15 is made into a rolled long web-shaped member having ends, which is moved from a pay-out spool 13 to a take-up spool 14 via the fixing nip portion N.

The fixed magnetic metallic strip 1C is induction-heated by a magnetic flux generated by an excitation coil 3, and a recording material P as a material to be heated is introduced into the fixing nip portion N, and is heated by the heat of the fixed magnetic metallic strip 1C through the fixing film 15.

While the apparatuses of the above-described embodiments are electronic copying apparatuses of the transfer type, the present invention can be effectively applied as an image heating and fixing apparatus in any of various image forming apparatuses such as a copier, a laser beam printer, a facsimile apparatus, a microfilm reader printer, a display apparatus and a recording apparatus in which a toner image is directly formed and borne on electrofax paper, electrostatic recording paper or the like by an image forming process and means of the direct type, or an image by a thermal fusion toner is formed on a recording material by an image forming process and means of the magnetic recording image forming type or other suitable type, and is heated and fixed.

The heating apparatus of the present invention can be widely used not only as the image heating and fixing apparatus of the described embodiments, but also, for example, as an image heating and fixing apparatus for heating a recording material bearing an image thereon and improving the surface property thereof such as luster, an image heating apparatus for heating a recording material bearing an image thereon and tentatively fixing the image, a heating apparatus for feeding sheet-like articles and carrying out a drying process, a smoothing process, a laminating process, or the like.

The present invention is not restricted to the above-described embodiments, but covers all modifications identical in the technical idea.

What is claimed is:

1. An image heating apparatus for heating an image formed on a recording material, comprising:

a heating member; and an excitation coil for generating a magnetic field to induce an eddy current in said heating member, wherein of total electric power applied to said coil, a relation between active electric power W and reactive electric power W' is $$0.1 \leqq W/(W+W') \leqq 0.8.$$

2. An image heating apparatus according to claim 1, further having a relation that $$0.2 \leqq W/(W+W') \leqq 0.5.$$

3. An image heating apparatus according to claim 1, further comprising a temperature detecting element for detecting a temperature of said heating member, and control means for controlling electrical supply to said excitation coil so that the temperature detected by said temperature detecting element may be maintained at a set temperature.

4. An image heating apparatus according to claim 1, which is used in an image forming apparatus having a treating capability of 10 sheets/min. or greater.

5. An image heating apparatus according to claim 1, which is used in an image forming apparatus having a treating capability of 20 sheets/min. or greater, and has a relation that $0.15 \leqq W/(W+W') \leqq 0.8$.

6. An image heating apparatus according to claim 1, which is used in an image forming apparatus having a treating capability of 30 sheets/min. or greater, and has a relation that $0.2 \leqq W/(W+W') \leqq 0.8$.

7. An image heating apparatus according to claim 1, which is used in an image forming apparatus having a treating capability of 40 sheets/min. or greater, and has a relation that $0.25 \leqq W/(W+W') \leqq 0.8$.

8. An image heating apparatus according to claim 1, wherein said excitation coil has surface covering of resin thereon.

9. An image heating apparatus according to claim 8, wherein the resin is polyimide.

10. An image heating apparatus according to claim 8, wherein the resin is amideimide.

11. An image heating apparatus according to claim 8, wherein a heat-resisting temperature of the resin is 220° C. to 235° C.

* * * * *

UNITED STATES PATENT AND TRADEMARK OFFICE

CERTIFICATE OF CORRECTION

PATENT NO. : 6,456,818 B1
DATED : September 24, 2002
INVENTOR(S) : Toshinori Nakayama et al.

It is certified that error appears in the above-identified patent and that said Letters Patent is hereby corrected as shown below:

Column 9,
Line 36, “lost” should read -- loss --.

Column 10,
Line 33, “in used” should read -- is used --.

Signed and Sealed this

Fourth Day of March, 2003

JAMES E. ROGAN
*Director of the United States Patent and Trademark Office*